US006810993B2

(12) United States Patent
Promersberger et al.

(10) Patent No.: US 6,810,993 B2
(45) Date of Patent: Nov. 2, 2004

(54) ARTICULATED AERIAL DEVICE INCLUDING AN UPPER BOOM COMPENSATION UNIT

(75) Inventors: Jon M. Promersberger, Watertown, SD (US); Robert F. Ryan, Watertown, SD (US); John L. Pantzke, Clear Lake, SD (US)

(73) Assignee: Terex-Telelect, Inc., Westport, CT (US)

( * ) Notice: Subject to any disclaimer, the term of this patent is extended or adjusted under 35 U.S.C. 154(b) by 0 days.

(21) Appl. No.: 10/207,287

(22) Filed: Jul. 29, 2002

(65) Prior Publication Data

US 2004/0016596 A1 Jan. 29, 2004

(51) Int. Cl.[7] ..... E04G 1/00; E04C 1/00

(52) U.S. Cl. ..... 182/2.9; 182/63.1; 182/2.8

(58) Field of Search ..... 182/2.9, 2.8, 2.3, 182/2.1, 69.6, 2.6, 63.1; 212/196, 260, 255, 197, 261

(56) References Cited

U.S. PATENT DOCUMENTS

| | | | | | |
|---|---|---|---|---|---|
| 4,252,213 | A | * | 2/1981 | Ekman | 182/2.9 |
| 4,427,121 | A | * | 1/1984 | Clements | 182/2.8 |
| 4,514,796 | A | * | 4/1985 | Saulters et al. | 182/2.8 |
| 5,819,534 | A | * | 10/1998 | Fischer et al. | 182/2.9 |
| 5,944,204 | A | * | 8/1999 | Vollmer | 182/2.9 |
| 6,012,544 | A | * | 1/2000 | Backer et al. | 182/2.7 |
| 6,405,114 | B1 | * | 6/2002 | Priestley et al. | 182/2.9 |
| 6,488,161 | B1 | * | 12/2002 | Bean | 212/300 |

* cited by examiner

*Primary Examiner*—Hugh B. Thompson, II
(74) *Attorney, Agent, or Firm*—Andrus, Sceales, Starke & Sawall, LLP

(57) ABSTRACT

An aerial lift apparatus unit includes at least a lower boom pivotally interconnected to a transport unit for raising and lowering of the lower boom. An upper boom is pivotally connected to the outer end of the lower boom for raising and lowering of the upper boom with respect to the lower boom. A single integrated lifting and compensating cylinder unit includes an elongated cylinder with a piston and piston rod journaled in the one end and operable to extend outwardly therefrom. The cylinder defines a dual operating cylinder with a base end from which the piston rod extends and an inner base end extending from the base end and defining an upper boom/compensating unit. A hydraulic control system includes a first hydraulic gated control system for raising and positioning of the upper boom relative to the lower boom. A hydraulic unit and control system for raising and lowering of the lower boom includes a control module connected to the upper boom/compensating unit and an interrelated positioning module to the lower boom and connected to the hydraulic system for raising and lowering of the lower boom. The control module and lower boom module are connected to each other in response to the flow of hydraulic fluid for lowering and raising of the lower boom and simultaneously provide for direct transfer of fluid from the rod end and the base end of the upper boom positioning unit with the fluid flow and control of the lower boom to position the upper boom to maintain its preset orientation with respect to the ground. The compensating module includes valves connected to the opposite sides of the upper boom for establishing an interrelated flow between the boom/compensating unit and thereby the upper cylinder and the lower cylinder during movement of the lower boom.

15 Claims, 2 Drawing Sheets

ARTICULATED AERIAL DEVICE INCLUDING AN UPPER BOOM COMPENSATION UNIT

BACKGROUND OF THE INVENTION

This invention relates to an articulated aerial device with a plurality of interconnected booms including a lower boom and an upper boom and having a hydraulic upper boom compensation apparatus, and particularly a hydraulically actuated upper boom angle control for maintaining the upper boom angle relative to the lower boom during the raising and lowering of the lower boom assembly.

The compensation of the upper boom is desirable to maintain the angular orientation with respect to the ground or other support structure in a constant relative position. Thus, a supporting basket or other member is often secured to the uppermost boom within which workmen and equipment reside for operating in the aerial position.

An improved articulated aerial device such as widely used for locating operating personnel at elevated levels as well as requiring prompt elevated positioning is disclosed in U.S. Pat. No. 5,819,534, issued Oct. 13, 1998. The lift system disclosed therein includes a hydraulic motor assembly interconnecting the upper and lower boom and a lifting apparatus for pivoting of the lower boom. The hydraulic circuit for the upper boom includes a separate compensating cylinder unit which is connected in end relationship to the upper boom positioning cylinder unit. The compensating cylinder unit is a separate unit secured to the lift cylinder unit including separate interconnections and mounting relative to the upper boom positioning cylinder unit with an interrelated special fluid controlled supply and exit from the separate compensating cylinder. A lower boom hydraulic supply is connected to a control unit to supply hydraulic fluid to the lower boom cylinder unit, and simultaneously to the upper boom compensating cylinder unit to provide a coordinated position control. The system permits the independent positioning of the two booms. Thereafter, the separate compensating cylinder unit is controlled in response to the lowering and raising of the lower boom to establish automatic compensation by redirecting of the pressurized hydraulic fluid to the compensating system including the separate compensation cylinder and the lower boom cylinder to maintain a desired positioning of the upper boom.

Although the system provides a highly effective hydraulic compensating system for movement of the lower boom unit and the upper boom unit, the separate special cylinder construction requires a multiple interconnection and mounting of the apparatus and connecting of the various hydraulic systems.

SUMMARY OF THE INVENTION

The present invention is directed to a hydraulic system for controlling the relative position of an upper boom relative to the ground with a single integrated upper boom positioning and compensating cylinder unit (hereinafter referred to as an upper boom/compensating cylinder unit) including a rod end and a base end as a single hydraulic cylinder in combination with separate hydraulic supply unit to the upper boom and connection of the lower positioning unit to the supply with the integrated upper boom/compensating cylinder unit. A separate compensating manifold or module unit is interconnected to the opposite elements of the upper boom/compensating cylinder unit which responds with an interrelated control of the lower boom lifting apparatus. This permits the independent positioning of the lower boom and the upper boom as well as maintaining the desired orientation of the upper boom with changes in the lower boom without changing of the angular orientation of the upper end of the upper boom relative to the base supporting system of the booms.

In accordance with the present invention, the upper boom/compensating cylinder unit is formed as a single cylinder having a rod end inclusive of a piston and a rod projecting outwardly of the positioning rod end. The piston defines a compensating cylinder end extending outwardly in the opposite direction of the piston from the rod end. For independently positioning of the upper boom, a first flow control system is connected to provide differential proportional flow to and from the rod end and the base end of the upper boom/compensating cylinder unit in accordance with the difference in the cross sectional and volumetric capacity of the respective chambers. In addition, a separate module section is interconnected between the rod end and the base end of the cylinder of the upper boom/compensation cylinder and the lower boom hydraulic positioning unit to establish a hydraulic fluid flow to and from the lower boom cylinder unit and with a compensating flow from the upper boom and compensating cylinder unit to maintain a desired precise orientation between the upper boom and the ground.

The present invention establishes a simplified system providing for independent boom positioning as well as the interrelated control.

In the preferred construction, the upper boom control includes a holding valve assembly which may have a direct control for the independent movement of the upper boom unit. The main positioning control of the upper boom produces direct upper boom positioning thereof is through a special supply for balancing the flow to and from the opposite ends of the upper boom cylinder unit as such. It permits controlling of the angle of the upper boom relative to the lower boom. The interconnection of the lower boom hydraulic system includes a holding valve manifold connected to a similar manifold at the upper boom/compensating unit which provides for a necessary hydraulic flow from the supply and to and from the respective rod end and base end of the respective lower and upper boom units for positioning of the lower boom and repositioning of the upper boom.

The present invention thus provides a hydraulic system for providing of a hydraulic upper boom compensation and maintaining the orientation between the upper boom and the ground with a simplified and more cost effective system.

BRIEF DESCRIPTION OF THE DRAWINGS

The drawings furnished herewith illustrates a preferred construction of the present invention in which the above advantages and features are clearly disclosed as well as others which will be readily understood from the following description of the illustrated embodiments.

In the drawings.

DETAILED DESCRIPTION OF THE PREFERRED EMBODIMENT

Figure 1:
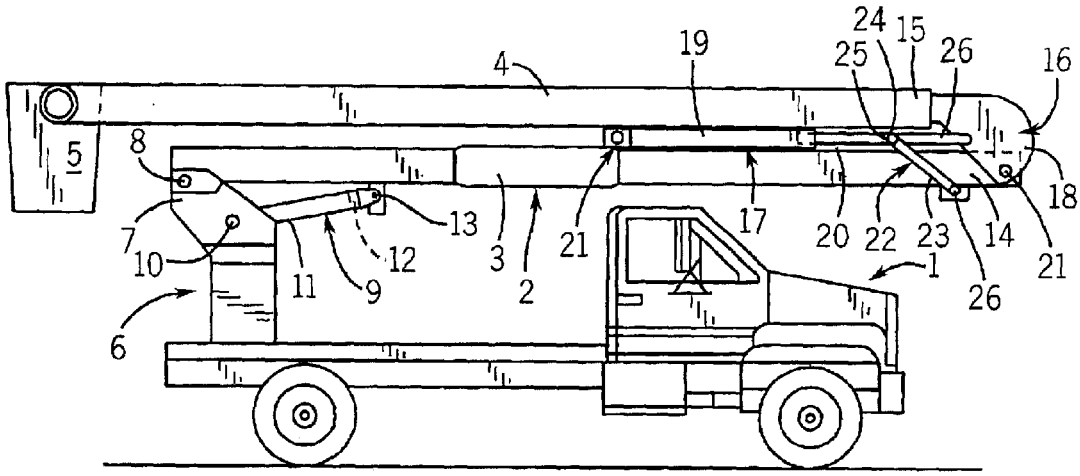
FIG. 1 is a simplified illustration of a truck mounted aerial lift assembly for locating an operator in various raised orientations.
Figure 2:
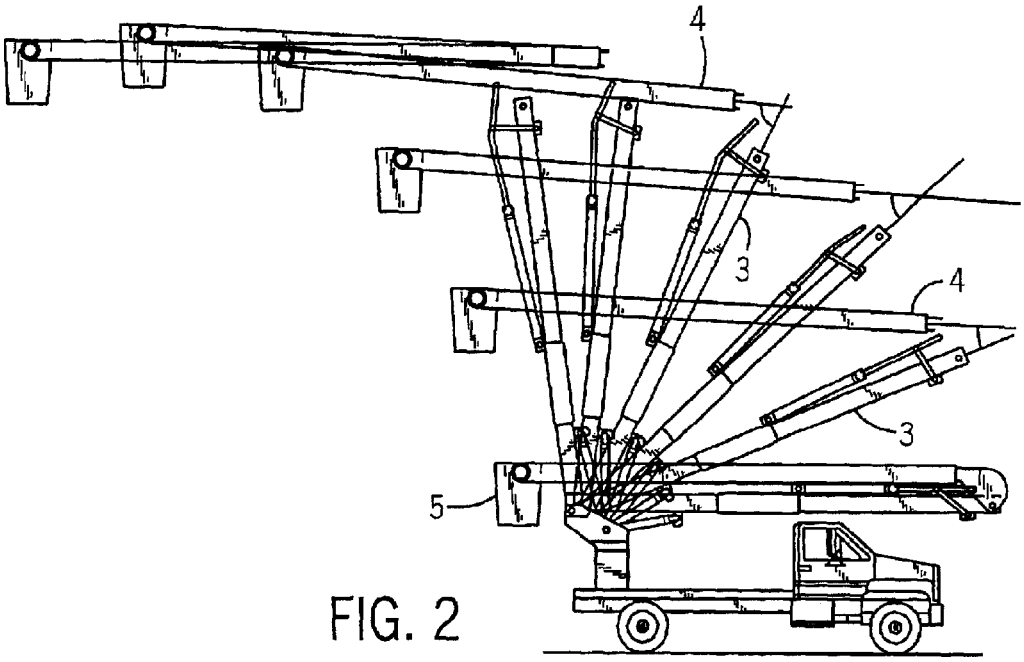
FIG. 2 is a diagrammatic illustrations of the booms shown in FIG. 1, illustrating different positions of aerial lift device with a substantially fixed orientation of the upper boom and a supporting basket during raising and lowering of the lower boom.

Referring to the drawings and particularly to FIGS. 1–2, a mobile aerial lift apparatus is illustrated in a simplified presentation for clarity of illustration. FIG. 1 illustrates the apparatus including a truck 1 with an aerial lift unit 2 mounted to the bed thereof. The aerial lift unit 2 includes a lower boom 3 and an upper boom 4 pivotally interconnected to each other and to a support 6 including a rotating support bracket 7. A basket 5, as shown, is secured to the outer end of the upper boom 4 within which operating personnel, equipment or other elements may be located during the lifting and locating of the booms within a selected area or location. Basket 5 is typically pivotally attached to the outer end of the boom 4 to maintain a horizontal (level) orientation at all times. The aerial lift unit is mounted to the truck bed through the support 6. The rotating support bracket 7 is secured to support 6 and projects upwardly. The lower boom 3 is pivotally connected as at pivot 8 to the rotating support bracket 7. A lift cylinder unit 9 is connected between bracket 7 and the lower boom 3. In the illustrated embodiment, a pivot connection 10 connects lower boom cylinder 11 of unit 9 to the rotating support bracket 7. A cylinder rod 12 extends from the cylinder 11 and is pivotally connected to the lower boom 3 through a pivot 13. The lower boom cylinder unit 9 is connected to a hydraulic power supply of a suitable hydraulic fluid, as more fully developed hereinafter. The outer end 14 of the lower boom 3 is interconnected to the lower and pivot end 15 of the upper boom 4. A pivot unit 16 interconnects the outer end of the lower boom 3 to the pivot end 15 of the upper boom 4. An upper boom/compensating cylinder unit or assembly 17 is connected between the lower boom 3 and the upper boom 4 for pivoting of the upper boom about pivot member 16 for positioning of the upper boom 4 relative to the ground 3. The upper boom/compensating cylinder unit 17 is constructed to permit independent movement of the upper boom 4 relative to the lower boom 3 and also to provide a compensating motion between the booms 3 and 4 to maintain the upper boom and the basket in proper raised relationship with the ground during positioning movement of the lower boom.

The upper boom/compensating cylinder unit 17 is a single cylinder structure and provides a unique hydraulic interconnection and compensation for the upper boom 4 into a preset orientation of the upper boom relative to the support or ground, as more fully developed hereinafter.

The results of this interaction is depicted in the diagrammatic illustration of FIG. 2. In FIG. 2, the upper boom is preset to locate the boom and the basket 5 in a substantially constant level parallel to the ground and with the upper boom and the basket raising with the raising of the lower boom 3. The upper boom end and basket 5 maintain a substantially constant level relative to the ground and the support structure. The above illustration is similar to that disclosed in the previously identified U.S. Pat. No. 5,819,534 which uses back-to-back cylinders to produce a similar result.

The present invention is particularly directed to a special construction and interconnection of the upper boom/compensating cylinder unit 17 for direct positioning of the upper boom 4 relating to boom 3 and to also establish the automatic compensating positioning for maintaining the position of the boom 4 and the connected basket 5 during the movement of the lower boom, for example, as shown in FIG. 2.

Referring to FIGS. 1 and 2, the pivot unit 16 includes a bracket 18 fixed to the lower end of upper boom 4 and a connecting pivot 18*a* which interconnects the outer end of the lower boom 3 to the lower pivot end of the upper boom 4. The upper boom compensating cylinder unit or assembly 17 is connected between the outer end of the lower boom 3 and the pivot unit 16 connected to lower end of the upper boom 4.

Figure 3:
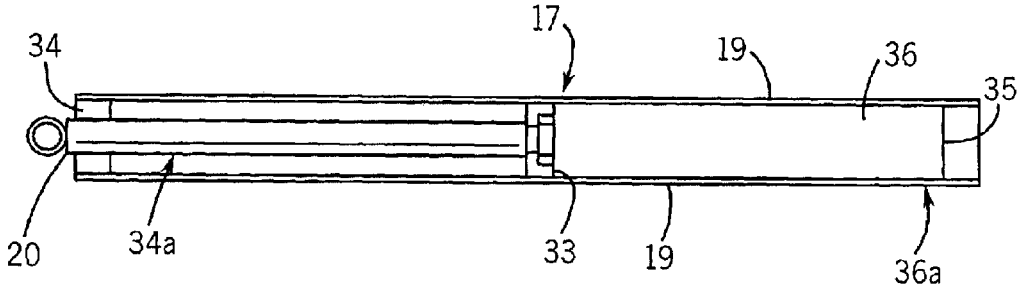
FIG. 3 is an enlarged view of an upper boom positioning unit.

The cylinder unit 17 is constructed with a single outer cylinder 19 and a connecting piston rod 20 extending from one end. The cylinder 19 has an opposite outer closed end connected to a pivot unit 21 to the lower boom 3. The rod 20 projects from the opposite end of the cylinder 19. A scissors coupling unit 22 includes a pair of arms 23 and 24 with a common pivot connection thereof to the rod 20 as at 25. The arms extend from the rod, with the outer end of arm 23 connected by pivot connection 26 to the boom 3 and the second arm 24 connected to the pivot unit 16 and particularly bracket 18 between the connection of pivot unit 16 to the booms 3 and 4. The coupling between the upper boom 4 and the boom 3 permits independent movement of the upper boom 4, as shown in FIGS. 2 and 3. The coupling also permits automatic positioning of the upper boom 4 as a result of movement of the boom 3 to establish a compensating motion of the upper boom for maintaining the upper boom in a preselected desired positioning with the movement of the lower boom as hereinafter shown and described with reference to FIGS. 1 and 2.

Figure 4:
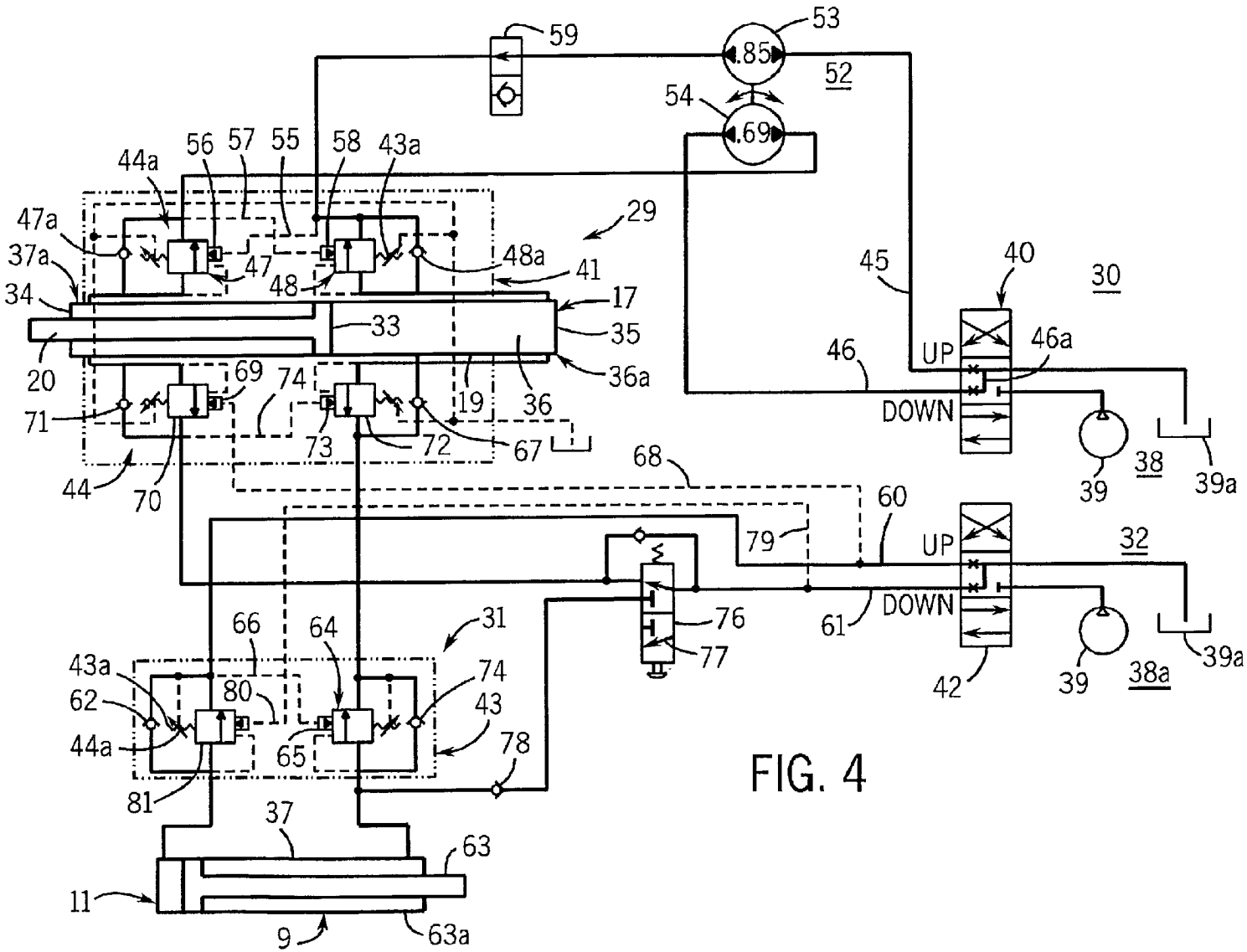
FIG. 4 is a schematic illustration of a hydraulic control for positioning of the lower and upper booms including a hydraulic compensating circuit and unit in accordance with the present invention.

In accordance with the illustrated embodiment of the invention, the upper boom 4 is connected, a shown in FIG. 4, to a separate hydraulic positioning system 29 which connects a hydraulic supply 30 to the opposite ends of the cylinder 19 of the cylinder unit 17 for supplying and removal of fluid to and from the opposite ends to locate and hold the cylinder and boom 4 in place.

A lower boom hydraulic positioning circuit or system 31 connects the hydraulic supply 30 to the lower boom lift cylinder unit 9 for positioning of the lower boom 3 relative to the upper boom 4 and with a compensating movement of the upper boom 4.

More particularly, with reference to FIG. 4, the upper boom/compensating cylinder assembly or unit 17 includes the single cylinder 19 with the cylinder rod 20 connected to a piston 33 therein and with the rod 20 projecting outwardly of the one end wall 34; and defining a basic rod end 34*a* of the cylinder unit 17. The opposite end 35 of the cylinder 19 is closed and defines a compensation chamber 36 between the piston 33 and the closed end 35 of the cylinder, hereinafter referenced as the compensation end 36*a*.

The closed end of the cylinder unit 17 is pivotally interconnected to the lower boom 3 as at 21 (FIG. 1) with the piston rod 20 projecting outwardly therefrom. The outer end of the piston rod is pivotally connected by the scissors coupling unit 22 to the pivot member 16 and to the lower boom 3 by arm 23. This structure is similar to that disclosed in the previously identified patent.

Referring particularly to FIG. 4, the boom/compensating cylinder unit 17 includes the elongated outer cylinder 19 which is separated internally by the piston 33. The rod 20 extends from the piston 33 outwardly through the one end and defines the rod or base end 34*a* of the boom/compensating cylinder unit 17. The opposite side of the cylinder 19 is closed by the end wall 35 and with the piston defines a compensation chamber at the outer compensating end 36*a* of the cylinder unit 17.

The piston rod 20 is connected to the pivotal connection between the upper and lower booms as described above.

The base end 36*a* of the cylinder 19 of the unit 17 is pivotally secured to the lower boom, as at pivot 21 in FIG. 1. The extension of the cylinder rod 20 and the retraction thereof provides for the relative positioning of the upper boom 4 relative to the ground 3. As presently discussed, the upper boom 3 and compensation cylinder unit 17 are connected to the hydraulic supply 30 for selective and independent operation to raise and lower the upper boom. Boom 3 is also connected into the circuit for positioning of the lower boom 3 to provide automatic compensating positioning of the upper boom 4 with movement of the lower boom 3, as hereinafter discussed.

The lower boom 3 is connected into the system through the lower boom cylinder unit 9. This is a direct interconnection and provides for the pivotal movement of the lower boom 3.

The cylinder 19 of the upper boom/compensation unit 17 and the cylinder 37 of lift cylinder unit 9 for the lower boom 3 are constructed with essentially identical cylinder diameters and the piston and rod units are similarly of equal construction for reasons hereinafter disclosed.

During the operation, the lower boom cylinder unit 9 operates to position the lower boom directly. The upper boom positioning unit 17 is connected to reposition the upper boom 4 separately and also is interconnected to the lower boom positioning system to automatically reposition the upper boom 4 relative to the lower boom 3 during repositioning of the lower boom to maintain a desired relationship and, in particular, locating of the upper boom 4 with its outer end and the structure 5 in predetermined relationship with respect to the ground support, as shown in FIG. 2.

A preferred hydraulic compensating circuitry is schematically illustrated in FIG. 4 with the appropriate interconnection between the several cylinder units and the hydraulic supply to provide the independent positioning of the upper boom followed by a modification of such positioning in accordance with the angular orientation and raising and lowering of the lower boom.

More particularly, as shown in FIG. 4, the hydraulic source 30 is shown connected to the upper boom/compensating cylinder unit 17 and to the lower boom cylinder unit 9. The source 3 is shown with a pressurized supply unit 39 and a drain or return unit 39*a*, which generally includes a suitable hydraulic fluid such as oil.

The upper boom 4 is interconnected to the pressurized hydraulic fluid supply or source 38. An upper boom three position valve 40 is shown connected between the pressurized supply 39 and a control module or manifold 41 interconnecting the fluid supply to the opposite ends of the upper boom/compensation cylinder unit 17.

A similar three position valve 42 is similarly interconnected between the lower boom hydraulic supply 38*a* and a control module 43 for positioning the lower boom 3.

The latter control system also includes interconnection of a compensating module 44, shown as part of unit 41, connected between the upper boom/compensation cylinder unit 17 and the control module 43 for positioning of the lower boom 3. The compensating module 44 provides interconnection of the upper boom/compensation cylinder unit 17 to the lower boom cylinder unit 9 and the supply 38*a* to supply fluid and drain fluid with respect to the positioning of the lower boom and to create the upper boom/compensation position.

Each of the module units 41, 43 and 44 is substantially of a like construction in the illustrated embodiment of the invention with appropriate gated holding valves connected to the opposite ends of the respective cylinders of the associated boom and with a one way or directional bypass valve, shown for purposes of illustration as ball check valves, connected in parallel with each gated holding valve. In the structure as built, the units 41 and 44 are not separate but are the same manifold.

In the illustrated embodiment of the invention, each of the holding valves includes similarly spring loaded limit control units 44*a* to provide pressure relief in the presence of excessive creation of pressure within the system. Thus, as illustrated, if the pressure rises against a set level, such as 4,000 psi, that system will automatically provide opening of that valve for draining thereof to a bypass drain receptacle. The systems will be readily recognized by those skilled in the art and no further description thereof is given other than the unique connection and function in connection with the positioning of the upper boom relative to the ground.

Referring again particularly to FIG. 4, the three position valve 40 for controlling the upper boom 3 is shown in a standby state with control line 45 and 46 connected as at 46*a* to each other for holding the system in a particular set location.

Each of the valves 40 and 42 is similarly constructed and includes a neutral position interconnecting the supply lines 45 and 46 of valve 40, and corresponding lines at valve 42, and thereby locking the hydraulic system to the respective boom units in a last position state. The three position valves each connect the supplies 38 or 38*a* to the related control lines to the upper boom unit and to the lower boom unit system.

The lifting or rising control for the upper boom 4 provides a direct connection to control module 41 for positioning of the upper boom 4 in a predetermined desired orientation with respect to the lower boom 3.

The upper boom cylinder unit 17 has the rod 20 projecting outwardly of the one end and the piston 33 defines the rod end 34*a* of unit 17. The piston 33 and the closed end 35 of the cylinder 19 defines the chamber 36 and the compensating end or section 36*a* of the upper boom/compensation cylinder unit 17.

The manifold unit 41 includes first and second gated valves 47 and 48 connected respectively to the rod end 34*a* of the cylinder 19 of unit 17 and to the base end 36*a* of the cylinder 19 of unit 17. In each instance, a one way ball check valve 47*a* and 48*a* is shown connected in parallel with the holding valves 47 and 48. The check valves and the gated valves are shown as a preferred construction but other functioning devices which will permit the interrelated type of a control as more fully developed hereinafter may be readily used.

The valve units interconnect the opposite functioning portions of the unit 17 to establish a proportionate flow control system to maintain a balance within and to the opposite sides of piston 33 in the cylinder unit 17. The compensating chamber 36 has a greater volume than the rod end by the size of the rod.

For positioning of the upper boom 4 relative to the lower boom 3, the supply lines 45 and 46 from valve 40 are selectively connected between the raising position and the lowering position by appropriate setting of the three way position valve 40 from the illustrated neutral state to either of the other two positions.

The up line 45 and the down line 46 are shown connected directly to each other within the valve by the central connector 46*a*.

For moving the boom, the valve 40 is moved to provide the interrelated supply and drain connections through lines 45 and 46 connected to the unit 17. The lines 45 and 46 are respectively connected through appropriate sides of a proportional flow control unit 52, which includes separate but interrelated units including a relatively high rate of flow control 53 in the line 45 and a relatively slow rate of flow unit 54 connected to the opposite supply line 46, from the switch unit 40. The flow control units 53 and 54 provide for balancing the flow to and from the respective cylinder ends to compensate for the different effective cross sectional area and volume and therefore the volumetric condition of the cylinder to the opposite sides of the piston. The relative volumes of fluid supplied to one side of cylinder 19 must be withdrawn from the opposite side. The base cylinder end 36*a* has a greater volume than the rod end 34*a* by the presence of the rod 20 which exists within the rod end 34*a*. In the illustrated embodiment of the invention, a ratio is indicated of a typical design with a 0.85 rate of flow to compensation end 36*a* of the cylinder and a lower 0.69 rate of flow to and from the rod end 34*a* of the cylinder, which was present in one embodiment of the invention.

The flow control units are bi-directional and permit the bi-directional flow through the lines 45 and 46 as necessary to supply and remove fluid from the cylinder unit 17 during the raising and lowering thereof.

Assuming the three way valve 40 is set to the position to raise the upper boom 4, the up line 45 is connected to the pressure side 39 of the supply 38 and the down line 46 is connected to the drain or return side 39*a* of the supply. The line 45 is connected through the proportional flow unit 52 and connected to the gated valve 48 and bypass check valve 48*a* connected in parallel therewith. The valve 48*a*, as shown, provides for a direct flow from line 45 bypassing the valve 48 and transmits the pressurized fluid into the cylinder 19 at the base end 36*a* thereof. This pressurizes the cylinder unit 17, and cylinder 19 in particular, to move the upper boom piston 33 and rod 20 of unit 17 as a unit outwardly to raise the boom 4. The boom is normally in a locked position by the connection of the valve units 47 and 47*a*. As shown in FIG. 4, line 45 downstream of unit 52 is also connected by a line 55 to control the valve 47 connected to the rod end 34*a* of the cylinder unit 17. The line 55 is connected to the gate 56 of the gated switch unit 47. Simultaneously with the pressurization of the compensation cylinder end 36*a*, the valve 47 opens and allows drain of fluid from the rod end 34*a* of the cylinder unit 17. Thus, the signals at the gate opens the holding valve unit 47 and allows the fluid to flow from the rod end outwardly to the proportional flow unit 54 while the supply fluids flows from the line 45 through the check valve 48*a* into the compensation cylinder end 36*a*. This proportional amount of fluid from the rod end of the cylinder unit 17 is connected to the drain 39*a* of the supply 30. This provides for the controlled raising of the upper boom 4 to any desired degree. The valve 40 is moved to the neutral position, shown in FIG. 4, when the boom has been raised to the desired position.

To lower the upper boom 4 from its raised position, the upper boom switch 40 is moved in the opposite direction and reversely connects the supply line 45 and 46 of the upper boom/compensating cylinder unit 17. In this alternate position, the supply side 39 of the hydraulic fluid source 38 is connected via line 46 to the low ratio drive 54 of the proportional drive unit 52 which provides the supply of fluid to the rod end 34*a* of unit 17. The ball check valve 47*a* bypasses the holding valve 47 which is connected to the rod end 34*a* of the cylinder unit 17. Further, the supply line 45 from the source for the upper boom is interconnected via a line 57 to the gate 58 of control valve or holding valve 48 connected to the base end 36*a* of the unit 17. The pressurized input at the gate 58 opens the valve 48 and allows the displacement of the hydraulic fluid from the compensation cylinder through the supply line 45 and the proportional control unit 53 which is now connected to the drain 39*a* of the hydraulic cylinder of the supply 30 in the position of switch 40. This permits the controlled lower of the upper boom 3.

In the above direct positioning of the upper boom, either up or down, the compensating module 44 is inactive and does not effect or interact with the system. This permits the direct positioning of the upper boom.

The direct positioning of the upper boom 4 automatically provides for the introduction of hydraulic fluid into one side of the boom/compensation cylinder unit 17 and the direct removal of fluid from the opposite side. There is no fluid flow permitted from the upper boom/compensation cylinder unit 19 in this stage as a result of the closure of holding valves and the ball check valves in module 44 which only permits the flow of fluid during signals from the lower boom control, as presently described.

An over center valve unit 59 is shown connected in the "up" line 61 of the upper boom control. This will limit the absolute angle of the upper boom 4 relative to the ground. If it tends to move beyond that point, the over center valve moves to connect a ball check valve in the line which closes the up supply line and prevents further "up" movement of the upper boom 4.

Raising or lowering of the lower boom 3 includes inclusion of its supply unit 32 and the respective lower boom module 43 into the system and further includes the compensating module 44 into interrelated controls through the lower boom three position control valve unit 42. The two lines 60 and 61 from the illustrated switch structure defines an up line 60 for raising of the lower boom and a down line 61 for lowering of the lower boom 3 by interconnection to the supply 32.

With the valve 42 located in the neutral position as shown, the lower boom is held in that position.

With the illustrated valve activated, the supply 39 and drain 39*a* are connected to raise the lower boom. The supply or pressurized side 3 of the hydraulic source 30 is connected to the raising or "up" line 60 at the output of the valve 42. The "up" line 60 is connected to the lower boom module 43 and, in particular, to a ball check valve 62 connected to the head or closed end of the lower boom cylinder 37 of cylinder unit 9. The valve 62 opens and pressurizes the closed end which tends to force the piston and rod 63 on the closed rod end 63*a* to extend the rod and thereby extend the cylinder unit 9 and the interconnected lower boom 3. The cylinder unit 9, however, is not connected directly to the return or down side or line 61. The return side at the rod end 63*a* of unit 9 is connected through module 43 to the compensating module 44 connected to the upper boom/compensation cylinder unit 17, as follows.

The power boom module 43 includes a holding valve 64 connected to the rod end 63*a* of unit 9. The gate 65 of valve 64 is connected to the pressurized up line 60 via a connecting line 66. The holding valve 64 thus opens and the hydraulic fluid in the rod end of cylinder unit 9 exits therefrom and flows through the valve 64 to the module 44 associated with the upper boom unit 17, and in particular, to a valving structure 44 connected to the base end 36*a* of the unit 17. The module 44 includes a check valve 67 which provides for direct flow of the fluid from the cylinder unit 9 into the base end 36*a* of the upper boom/compensation cylinder unit 17. The pressurization of the lift cylinder unit 9 is thereby transmitted to the base end of the cylinder 19 which simultaneously operates to move the piston 33 and rod 20 of the upper boom cylinder assembly outwardly and correspondingly raises the upper boom 3 and the related supported basket with the raising of the lower boom 3. In this position, again, the rod end of the cylinder unit 17 must allow drain or removal of fluid in a proportionate amount from the rod end. As shown in FIG. 4, the up line 60 of the lower boom control is connected via a signal line 68 to module 44 and particularly to the input gate 69 of a holding valve 70 connected to the rod end 34*a* of the unit 17. The valve 70 opens as a result of this signal and the pressurization at the base end is then free to move the piston and rod with the hydraulic fluid from the rod end 34*a* moving through the now open holding valve 70 and through the down line 61 to the exhaust or drain side 38*a* of the lower boom supply 32.

With the lower boom repositioned in the raised position, if there is any necessity to further reposition the upper boom relative thereto, the upper boom may of course be directly repositioned relative to the lower boom via the control valve 40.

If the lower boom 3 is lowered, with the upper boom maintained in its desired position, the control valve 42 of the lower boom 3 is set to reverse the circuit connection with the down line 61 connected to the supply side 39 and the "up" line 60 connected directly to the drain side 39*a* of the source 38*a*. In this position, the pressurized down line 61 is connected directly to the compensating module 44. A ball check valve 71 at the rod end 34*a* establishes a direct connection of the pressurized supply from line 61 to the base or rod end 34*a* of the cylinder 19 of unit 17. This provides a direct pressurizing of the cylinder 19 in a direction to move the rod inward and to lower the upper boom 3. To do so, the base unit 17 must move to collapse and move fluid from the compensation end 36*a*. The main holding valve 48 for original raised positioning of the boom 4 is in the closed position and the check valve bypass 48*a* is also closed. The base chamber 36 must then exit through the connection to module 44 which includes the check valve 67 connected thereto, but this check valve only provides for the opposite flow. The check valve, however, is connected in parallel with a gated valve 72. The gate 73 of the valve 72 is connected by a line 74 to the now pressurized down line 61 which opens the valve 72. The opening of the valve 72 allows the compensation cylinder 19 of unit 17 to force the fluid from the base end 36*a* through the holding valve 72 with the flow downwardly to module 43 and through a ball check valve 74, connected in parallel to gated valve 64, of the lower boom control module 43. This transmits the discharge fluid from the compensating cylinder unit 17 to the rod end 63*a* of the lower boom cylinder 9. This repositions the lower cylinder unit to correspondingly lower the boom 3 as desired.

With the upper boom preset in position by its positioning control, during the lower boom 3 repositioning, the upper boom 4 is automatically repositioned to maintain the desired orientation of the upper boom.

A valve 76 is shown which may be used to lower the lower boom 3 after the upper boom cylinder is fully retracted without repositioning the upper boom 4. Thus, moving the switch 76 to connect contact member 77 into the circuit connects line 61 directly to a check valve 78 to the rod end of the cylinder unit 9.

The down line 61 is also connected via a line 79 to the gate 80 of gated valve 81, which opens and allows fluid from the outer end to exit through up line 60 to the drain side 39*a* of supply 32.

In summary, the upper boom system includes a proportional flow system to simultaneously supply the appropriate volume of the hydraulic fluid to the rod end of the cylinder and a related proportional flow to and from the base end portion of the upper boom and compensation cylinder unit. The flow volume is directly proportional to the effective cross sectional area of the two cylinders. The valving system provides for direct flow to one of the chambers with a controlled valve release simultaneously to the opposite chamber. The compensating valve arrangement provided to the upper boom/compensation cylinder unit 17 includes the controlled flow system to and from the respective ends of the upper boom/compensation cylinder unit and the lower boom positioning cylinder unit which is selectively activated and operable with the lower boom setting to provide movement of the lower boom and simultaneously modify the position of the upper boom to maintain a predetermined orientation of the upper boom relative to the ground.

Although shown in a preferred construction, with the gated holding valves and ball check valves to provide for direct passage and for controlled passage of fluid to and from the several cylinder unit, any other form of one way and/or controlled valves can be provided which are responsive to the respective conditions to permit the desired interflow of the hydraulic fluids for raising and lowering of the boom and particularly with the automated compensation of the upper boom with movement of the lower boom.

A particular proportional flow control is also illustrated. Any other type of proportional flow control can, of course, be used which maintains related flows into and from the respective ends of the boom/compensation cylinder unit.

With the illustrated embodiment, the lift cylinder unit has a cross sectional construction corresponding to that of the upper boom compensation cylinder unit to permit the appropriate movement of the compensating liquid between the lower boom and the upper boom. If different sized booms are used, a flow control would also be used with appropriate proportional flows to maintain proper fluid transfers between the upper boom and the lower boom lift cylinders with the compensation unit operative.

Many other suitable hydraulic systems or other drive systems may be supplied which incorporate the basic functional features of the present invention, namely, that of providing the flow to and from a compensating cylinder unit for controlling of one boom relative to another through the single boom/compensating cylinder unit having a single cylinder divided by the boom rod and piston defining the compensation cylinder as well as the positioning cylinders.

The present invention provides a simplified hydraulic compensating unit contributing to a reduction in initial cost and the complexity of the control system as well as reduced maintenance of the system. Again, all of the valves are preferably similar control valve units having pressurized or other controlled inputs. The system may provide for direct flow to the cylinders through the check valves and controlled flow from the respective sides of the lift cylinder during the lowering or raising of the lower boom.

The present invention provides a simple, reliable and effective means to provide for the automated compensation of the positioning of the upper boom unit while permitting the free movement of the lower boom unit for repositioning of the supporting structure on the upper boom for optimal positioning thereof.

We claim:

1. An aerial lift apparatus comprising:

a support unit;

a lower boom and an upper boom, said lower boom being pivotally connected by a lower pivot unit to said support unit and extending outwardly therefrom, said upper boom being pivotally connected to the outer end of said lower boom by an upper pivot unit and adapted to be angularly oriented from a collapsed position adjacent to the lower boom and in an extended position raised with respect to said lower boom for locating the outer end of said upper boom in a raised position relative to said lower boom;

a lower boom hydraulic control unit connected to said support unit and to said lower boom for raising and lowering of the lower boom about its pivot axis; an upper boom compensating hydraulic unit including an upper boom direct positioning unit for presetting of the angular orientation of the upper boom relative to the lower boom, said upper boom compensating hydraulic unit further including a compensating hydraulic unit interconnected between said lower boom and said upper boom, wherein said upper boom compensating hydraulic unit including a single cylinder having a first open end and a second closed end with a piston and rod unit mounted within and extending from a first end of said cylinder and defining a positioning chamber at the rod end and further defining a compensating chamber at a base end formed by said second closed end of said cylinder, said upper boom compensating hydraulic unit including a flow circuit having a hydraulic fluid supply input and output, said flow circuit including control valve assemblies connected to said positioning chamber and to said compensating chamber of said upper boom compensating hydraulic unit and to said lower boom hydraulic unit to provide a selected interrelated movement of said upper boom relative to said lower boom in accordance with the movement of said lower boom about said pivot connection to said support unit, with said control valve assembly including a first valve unit connected to the rod end and a second valve unit connected to the base end of said upper boom compensating single cylinder, said first and second valve units being interconnected into circuits with first and second valve units connected to the boom cylinder and said lower boom fluid supply for providing said positioning of the lower boom with automated and direct repositioning compensation of the upper boom, with each of said valve units including a gated holding valve in combination with a bypass check valve to selectively provide for interrelated fluid control to and from said compensating cylinder and to and from said lower boom cylinder.

2. The aerial lift system of claim 1 wherein said upper boom compensating cylinder and said lower boom cylinder have corresponding cross sectional configurations and corresponding piston and piston rod cross sections.

3. The aerial lift apparatus of claim 2 wherein the hydraulic supply connection to said upper boom for positioning of the upper boom includes compensating flow controls for establishing a proportionate flow to and from the opposite ends of the single cylinder to provide for the differential volume of the fluids to the opposite ends of said single cylinder.

4. The aerial lift apparatus of claim 1 wherein said upper boom compensation single cylinder consists of a cylinder of a constant diameter having a closed end and an apertured rod end with a rod and piston unit mounted within the cylinder and with the rod projecting outwardly in sealed relation through the open end of the cylinder, said pivotal connection between said upper boom and said lower boom including a pivot unit secured to the outer base end of the pivot end of the upper cylinder and pivotally connected to the outer end of the lower cylinder to locate said upper cylinder in substantially parallel relation to said lower boom in the lower position of the upper boom, said upper boom compensating cylinder having the closed end of the cylinder interconnected to the top side of the lower boom, said piston rod extending outwardly and being pivotally interconnected to a connecting element connecting the upper boom to the lower boom, and a pivot lever interconnected between an intermediate location of said piston rod and to the lower boom providing for the angular orientation of the upper boom relative to the lower boom by said operation of said upper boom compensation hydraulic unit.

5. The aerial lift apparatus of claim 1 wherein said upper boom positioning unit includes an up line and a down line selectively connected to a pressurized hydraulic supply, said controlled valve assemblies including a first valve unit interconnecting of said up line to the base end of said upper boom compensation cylinder unit, said first valve unit including a gated valve connected between said supply line and said cylinder unit, said gated valve being normally closed and having a gate for selectively opening the valve, a bypass valve responsive to pressure in said up line to open and provide direct flow around said gated valve to said base end of said cylinder, said down line being connected to the rod end of said upper boom compensation cylinder unit and including a switch module comprising a normally closed gated switch in parallel with a directional flow control valve operable which directly provides for flow from the rod end to the down line, said gated valve connected to the base end of said cylinder unit having a gate connected directly to the down line, said gated valve connected to said rod end having its gate connected directly to the up line of said supply.

6. The aerial lift apparatus of claim 1 wherein said cylinders and rods have equal and constant diameters and wherein said lower boom hydraulic control unit includes an up line and a down line connected to said hydraulic fluid supply, a lower valve module included in said up line being connected by a valve assembly to the closed end of the lift cylinder, said valve assembly including a first directional valve providing for direct flow from the up line to the closed end of the lower lift cylinder and a first parallel gated valve providing for flow from the closed end of the lift cylinder to the up line, said lower valve module including a second gated valve unit connected to the rod end of the lower boom lift cylinder and a second directional valve connected to prevent flow from the rod end of the lower boom lift cylinder and a parallel gated valve connected to establish flow from the rod end of the cylinder, the gate of said first gated valve being connected directly to the up line establishing a flow from the rod end of the lift cylinder during the extension and lifting of the lower boom, the output side of the second directional valve assembly connected to the rod end of the lift cylinder unit is connected directly to a corresponding valve unit connected to the base end of the upper boom compensation cylinder unit, said base end valve assembly including a flow responsive valve providing for flow from the lower boom switch unit to the base end of the upper boom compensation cylinder unit and is operable therefore during the raising of the lower boom to simultaneously provide flow to the compensation end of the upper boom compensation cylinder unit, a second control valve module connected to the rod end of the upper boom compensation cylinder unit and is connected to the down line of the lower boom side, said second compensating cylinder unit switch including a one way directional valve providing for direct flow from the down line to the rod end of the upper boom compensation cylinder unit and a gated valve normally closed and connected between said upper boom compensation cylinder unit and the down line.

7. The aerial lift apparatus of claim 1 wherein said controlled valve assemblies include:

a lowering valve module connected between the hydraulic supply and the rod end and a raising valve module connected between the hydraulic supply and the base end of the upper boom cylinder, each of said valve modules including a gated valve connected to the cylinder at the respective ends of single cylinder, a by-pass valve connected in parallel with each gated valve and providing for flow only from the supply to a corresponding end of the single cylinder, each of said gated valves including inputs for opening the valves and providing for flow in the direction from the cylinder to said supply, said gated valves each having a control input connected to the supply connection to the input of the opposite gated valve, a lower boom positioning valve assembly comprising a lowering valve module and a raising valve module corresponding to the upper boom positioning valve assembly, a compensation position valve assembly comprising a first compensating valve module and a second compensating valve module connected to said lower boom positioning valve assembly to said upper boom positioning cylinder and to said hydraulic supply to maintain the preset position of the upper boom during the raising and lowering of the lower boom.

8. The aerial lift apparatus of claim 7 wherein each of said valve assemblies includes first and second controlled valve units interconnected to the respective cylinders, each of said controlled valves units connected to the opposite sides of the pistons within the respective connected cylinders to establish the interrelated flow of the hydraulic fluids relative to the supply and each other for repositioning the upper boom with respect to the lower boom.

9. The aerial lift apparatus of claim 8 wherein each of said valve assemblies is constructed with first and second gated valves and first and second parallel one directional flow valves connected to the opposite ends of the upper boom cylinder and the lower boom cylinder to establish independent positioning of the upper boom and to establish repositioning of the upper boom with positioning of the lower boom.

10. The aerial lift apparatus of claim 7 including a flow ratio between the rod end and the base end of the upper boom assembly to maintain the balanced flow between the opposite sides of the piston in the single cylinder.

11. The aerial lift apparatus of claim 10 wherein said gated valves each have a control input connected to the hydraulic input for opening the related valve units for positioning the booms.

12. The aerial lift apparatus of claim 11 wherein said one way by past valves is a check valve connected in parallel with the gated valves and establishing flow to the interconnected cylinders.

13. The aerial lift apparatus of claim 1 wherein said controlled valve assemblies include an upper boom valve assembly connected to said upper boom assembly and including a first valve assembly including a first valve unit connected to the rod end of the upper cylinder and a second valve unit to the base end of the upper cylinder, each said valve unit includes gated valves connected to one each of the opposite ends of the cylinder to establish controlled flow from the cylinder to the supply and having a by-pass valve is parallel with each gated valve to provide for flow from the supply to the cylinder, a compensating valve assembly connected to said upper boom assembly and including a first compensating valve unit connected to the rod end of said upper cylinder and a second compensating valve unit connected to the base end of said cylinder, each of said compensating valve units including a gated valve connected to establish flow from the cylinder and a parallel by-pass valve in parallel with each gated valve to establish flow to the cylinder, a lower boom valve assembly connected to said lower boom assembly and including a first lower boom valve unit connected to the rod end of the lower boom and a second lower boom valve unit connected to the base end of the lower boom, each of said lower boom valve units including a gated valve connected to establish flow from the lower boom cylinder and a parallel by-pass valve in parallel with the gated valve to establish flow to the cylinder, a hydraulic fluid supply, a control switch connecting said upper boom valve assembly connected to said hydraulic fluid supply input and including a raising line connected to said upper boom assembly and to the by-pass valve to supply fluid to the base end and connected to the gate of the gated valve connected to the rod end of said single cylinder, and including a down line connected to the gated valve of the rod end and to the by-pass valve of the rod end and to the gate of the gated valve of the base end of the single cylinder, said control switch operable to connect a hydraulic source to selectively connect the upper boom valve assembly to raise or lower the upper boom;

a control switch connecting said lower boom valve assembly and said compensating valve assembly to said hydraulic fluid supply and including a lower boom raising line and a lower boom lowering line, said lower boom raising line being connected to a grated valve unit connected to the lower boom base end and to the gate of the gated valve connected to the rod end and to the by-pass valve of the base end and being further connected to the gate of the gated valve of the compensating valve unit connected to the rod end of the upper boom, and said lower boom down line being connected to the gated valve of said compensating valve assembly connected to the rod end of the upper boom single cylinder, said lower boom down line being connected to the gate of the gated valve connected to the base end of the lower boom cylinder, and said gated valve unit connected to the rod end of the lower boom cylinder being connected to the gated valve unit of the compensating valve unit connected to the base end of the single cylinder of said compensating valve assembly and thereby to the by-pass valve to supply hydraulic flow from the lower boom cylinder to the base end of the single cylinder of the upper boom, said down line being further connected to the by-pass valve of the compensating valve unit connected to the rod end of the single cylinder and to the gate of the gated valve connected to the base end of the said single cylinder, whereby said gated valve connected to the base end of the compensating cylinder opens and the hydraulic fluid passes from the compensating cylinder through the gated valve and to the by-pass valve of the lower boom valve assembly to the rod end of the lower boom assembly to lower the lower boom.

14. The aerial lift apparatus of claim 13 including a control switch connected in said down line and operable to disconnect the down line from the gated valve of the compensating valve assembly, said switch having a second position connecting said down line to a lower boom line connected to the rod end of down cylinder units, said lower boom line including a one-way valve permitting flow from said supply to the rod side of said lower boom cylinder, a closure valve connected across said control switch and closing the connection between the supply line and the line from the compensating module, said supply pressurizing the base end of said lower cylinder unit and establishing a pressure signal to open the gated valve connected to the gated valve connected to the base end of the down cylinder to establish lowering of the lower boom independently of the upper boom.

15. The aerial lift apparatus of claim 13 wherein said one-way valves are ball check valves.

* * * * *